US010935283B2

(12) United States Patent
Henderson et al.

(10) Patent No.: US 10,935,283 B2
(45) Date of Patent: Mar. 2, 2021

(54) AIR CONDITIONER WITH A FOUR-WAY REHEAT VALVE

(71) Applicant: Haier US Appliance Solutions, Inc., Wilmington, DE (US)

(72) Inventors: Richard Dustin Henderson, LaGrange, KY (US); Bryan Isaac D'Souza, Louisville, KY (US); Robert William Jewell, Louisville, KY (US); Timothy Scott Shaffer, LaGrange, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 134 days.

(21) Appl. No.: 15/908,925

(22) Filed: Mar. 1, 2018

(65) Prior Publication Data

US 2019/0271478 A1 Sep. 5, 2019

(51) Int. Cl.

| | |
|---|---|
| ***F25B 5/02*** | (2006.01) |
| ***F25B 6/02*** | (2006.01) |
| ***F25B 41/06*** | (2006.01) |
| ***F25B 41/04*** | (2006.01) |
| ***F25B 13/00*** | (2006.01) |

(Continued)

(52) U.S. Cl.

CPC ..... *F25B 5/02* (2013.01); *F25B 6/02* (2013.01); *F25B 13/00* (2013.01); *F25B 41/04* (2013.01); *F25B 41/06* (2013.01); *F24F 3/153* (2013.01); *F24F 2003/144* (2013.01); *F25B 2313/02331* (2013.01); *F25B 2313/02334* (2013.01); *F25B 2313/02343* (2013.01); *F25B 2313/02742* (2013.01); *F25B 2341/0662* (2013.01)

(58) Field of Classification Search

CPC .... F25B 5/02; F25B 6/02; F25B 13/00; F25B 41/04; F25B 41/043; F25B 41/046; F25B 41/062; F25B 41/06; F25B 2313/02331; F25B 2313/02334; F25B 2313/02343; F25B 2313/02742; F25B 2341/0662

See application file for complete search history.

(56) References Cited

U.S. PATENT DOCUMENTS

| | | | | |
|---|---|---|---|---|
| 6,321,558 | B1 | 11/2001 | Pruse | |
| 7,770,405 | B1 | 8/2010 | Dillon | |
| 2017/0254571 | A1 * | 9/2017 | Xie | F25B 13/00 |

(Continued)

FOREIGN PATENT DOCUMENTS

WO WO-2017216861 A1 * 12/2017 ..... F25B 49/02

OTHER PUBLICATIONS

"Bulkhead." In Collins English Dictionary, edited by Collins Dictionaries. 12th ed. Collins, 2014. https://search.credoreference.com/content/entry/hcengdict/bulkhead/0?institutionId=743.*

*Primary Examiner* — Tavia Sullens
(74) *Attorney, Agent, or Firm* — Dority & Manning, P.A.

(57) ABSTRACT

An air conditioner unit includes a compressor, an exterior coil, a main interior coil, a main expansion device, a reheat interior coil and a reheat expansion device. The reheat interior coil is positioned adjacent the main interior coil. The main expansion device is connected in series between the exterior coil and the main interior coil, and the reheat expansion device is connected in series between the main expansion device and the reheat interior coil. A reheat valve is operable to selectively adjust a flow direction through the reheat interior coil. The reheat valve is a four-way valve, and one port of the four-way valve is blocked.

16 Claims, 6 Drawing Sheets

(51) Int. Cl.
*F24F 3/153* (2006.01)
*F24F 3/14* (2006.01)

(56) References Cited

U.S. PATENT DOCUMENTS

2017/0299202 A1* 10/2017 Hancock ..... F25B 13/00
2019/0331375 A1* 10/2019 Tanaka ..... F25B 13/00

* cited by examiner

AIR CONDITIONER WITH A FOUR-WAY REHEAT VALVE

FIELD OF THE INVENTION

The present subject matter relates generally to air conditioners, such as packaged terminal air conditioner units.

BACKGROUND OF THE INVENTION

Air conditioner units are conventionally utilized to adjust the temperature within structures such as dwellings and office buildings. In particular, one-unit type room air conditioner units may be utilized to adjust the temperature in, for example, a single room or group of rooms of a structure. Generally, one-unit type air conditioner units include an indoor portion and an outdoor portion. The indoor portion is generally located indoors, and the outdoor portion is generally located outdoors. Accordingly, the air conditioner unit generally extends through a wall, window, etc. of the structure.

Dehumidifying a room with one-unit type air conditioner units can remove latent water and suitably cool the room. However, under certain conditions, dehumidifying the room with one-unit type air conditioner units can be problematic. For example, when an exterior temperature is low, less than about seventy-five degrees Fahrenheit (75° F.), and humidity is high, greater than seventy-five percent (75%), one-unit type air conditioner units may overcool the room trying to reduce the excess humidity. Certain one-unit type air conditioner units include an extra refrigeration coil that can be throttled to re-heat the overcooled air, but the extra coil is costly and restricts airflow.

BRIEF DESCRIPTION OF THE INVENTION

An air conditioner unit includes a compressor, an exterior coil, a main interior coil, a main expansion device, a reheat interior coil and a reheat expansion device that are positionable within a casing. The reheat interior coil is positioned adjacent the main interior coil. The main expansion device is connected in series between the exterior coil and the main interior coil, and the reheat expansion device is connected in series between the main expansion device and the reheat interior coil. A reheat valve is operable to selectively adjust a flow direction through the reheat interior coil. The reheat valve is a four-way valve, and one port of the four-way valve is blocked. Additional aspects and advantages of the invention will be set forth in part in the following description, or may be apparent from the description, or may be learned through practice of the invention.

In a first example embodiment, an air conditioner unit includes a compressor, an exterior coil and a main interior coil. The compressor is operable to increase a pressure of a refrigerant. A main expansion device is connected in series between the exterior coil and the main interior coil. A reheat valve is operable to selectively adjust a flow direction through the reheat interior coil. A reheat interior coil is positioned adjacent the main interior coil. A reheat expansion device is connected in series between the main expansion device and the reheat interior coil. The reheat valve is a four-way valve, and one port of the four-way valve is blocked.

In a second example embodiment, an air conditioner unit includes a compressor, and an exterior coil and an interior coil. The compressor is operable to increase a pressure of a refrigerant. A bulkhead is positioned between the exterior coil and the main interior coil. A main expansion device is connected in series between the exterior coil and the main interior coil. A reheat interior coil is positioned adjacent the main interior coil. A reheat expansion device is connected in series between the main expansion device and the reheat interior coil. A reheat valve is operable to selectively adjust a flow direction through the reheat interior coil. The reheat valve is a four-way valve, and one port of the four-way valve is blocked.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
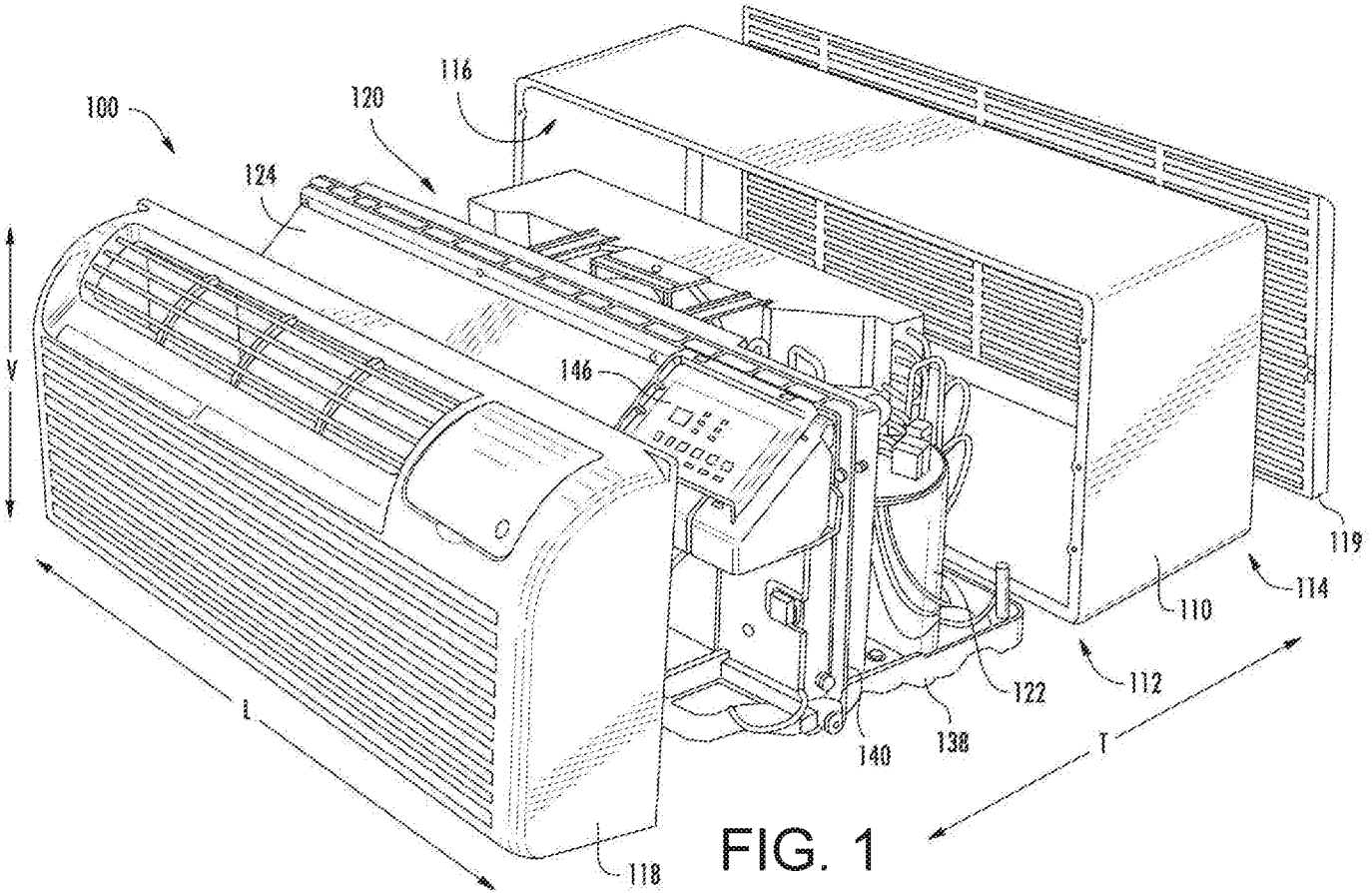
FIG. 1 is an exploded perspective view of a packaged terminal air conditioner unit according to an example embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides an exploded perspective view of a packaged terminal air conditioner unit 100 according to an example embodiment of the present subject matter. It will be understood that, while described in greater detail below in the context of packaged terminal air conditioner unit 100, the present subject matter may be used in or with any suitable air conditioner. For example, the present subject matter may be used in or with any suitable package terminal air conditioner, package terminal heat pump, single package vertical air conditioner, etc.

Packaged terminal air conditioner unit 100 is operable to generate chilled and/or heated air in order to regulate the temperature of an associated room or building. As will be understood by those skilled in the art, packaged terminal air conditioner unit 100 may be utilized in installations where split heat pump systems are inconvenient or impractical. As discussed in greater detail below, a sealed system 120 of packaged terminal air conditioner unit 100 is disposed within a casing 110. Thus, packaged terminal air conditioner unit 100 may be a self-contained or autonomous system for heating and/or cooling air. Packaged terminal air conditioner unit 100 defines a vertical direction V, a lateral direction L and a transverse direction T that are mutually perpendicular and form an orthogonal direction system.

As used herein, the term "packaged terminal air conditioner unit" is used broadly. For example, packaged terminal air conditioner unit 100 may include a supplementary electric heater (not shown) for assisting with heating air within the associated room or building without operating the sealed system 120. However, as discussed in greater detail below, packaged terminal air conditioner unit 100 may also include a heat pump heating mode that utilizes sealed system 120, e.g., in combination with an electric resistance heater, to heat air within the associated room or building. Thus, it should be understood that "packaged terminal air conditioner unit" as used herein is intended to cover both units with and without heat pump heating modes.

As may be seen in FIG. 1, casing 110 extends between an interior side portion 112 and an exterior side portion 114. Interior side portion 112 of casing 110 and exterior side portion 114 of casing 110 are spaced apart from each other. Thus, interior side portion 112 of casing 110 may be positioned at or contiguous with an interior atmosphere, and exterior side portion 114 of casing 110 may be positioned at or contiguous with an exterior atmosphere. Sealed system 120 includes components for transferring heat between the exterior atmosphere and the interior atmosphere, as discussed in greater detail below.

Casing 110 defines a mechanical compartment 116. Sealed system 120 is disposed or positioned within mechanical compartment 116 of casing 110. A front panel 118 and a rear grill or screen 119 hinder or limit access to mechanical compartment 116 of casing 110. Front panel 118 is positioned at or adjacent interior side portion 112 of casing 110, and rear screen 119 is mounted to casing 110 at exterior side portion 114 of casing 110. Front panel 118 and rear screen 119 each define a plurality of holes that permit air to flow through front panel 118 and rear screen 119, with the holes sized for preventing foreign objects from passing through front panel 118 and rear screen 119 into mechanical compartment 116 of casing 110.

Packaged terminal air conditioner unit 100 also includes a drain pan or bottom tray 138 and an inner wall or bulkhead 140 positioned within mechanical compartment 116 of casing 110. Sealed system 120 is positioned on bottom tray 138. Thus, liquid runoff from sealed system 120 may flow into and collect within bottom tray 138. Bulkhead 140 may be mounted to bottom tray 138 and extend upwardly from bottom tray 138 to a top wall of casing 110. Bulkhead 140 limits or prevents air flow between interior side portion 112 of casing 110 and exterior side portion 114 of casing 110 within mechanical compartment 116 of casing 110. Thus, bulkhead 140 may divide mechanical compartment 116 of casing 110.

Packaged terminal air conditioner unit 100 further includes a controller 146 with user inputs, such as buttons, switches and/or dials. Controller 146 regulates operation of packaged terminal air conditioner unit 100. Thus, controller 146 is in operative communication with various components of packaged terminal air conditioner unit 100, such as components of sealed system 120 and/or a temperature sensor, such as a thermistor or thermocouple, for measuring the temperature of the interior atmosphere. In particular, controller 146 may selectively activate sealed system 120 in order to chill or heat air within sealed system 120, e.g., in response to temperature measurements from the temperature sensor.

Controller 146 includes memory and one or more processing devices such as microprocessors, CPUs or the like, such as general or special purpose microprocessors operable to execute programming instructions or micro-control code associated with operation of packaged terminal air conditioner unit 100. The memory can represent random access memory such as DRAM, or read only memory such as ROM or FLASH. The processor executes programming instructions stored in the memory. The memory can be a separate component from the processor or can be included onboard within the processor. Alternatively, controller 146 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Figure 2:
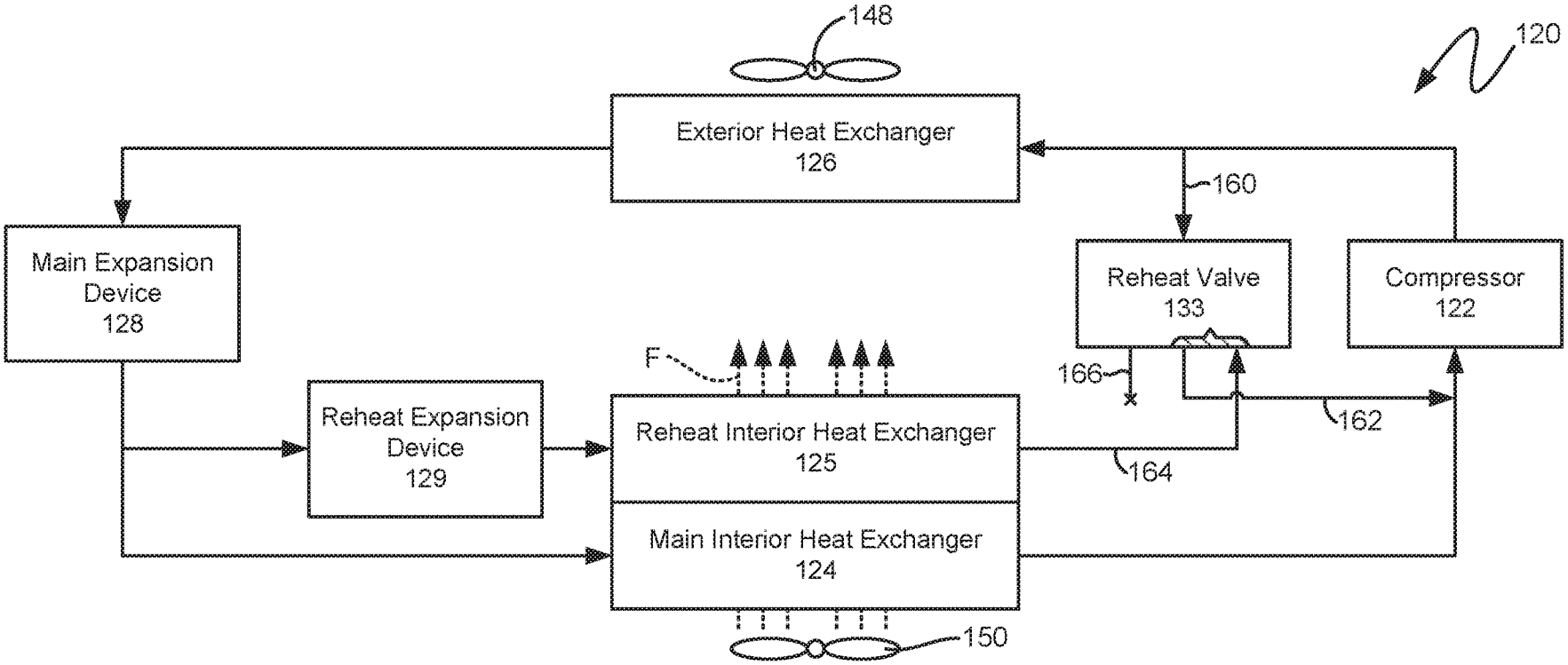
FIGS. 2 and 3 are schematic views of a sealed system according to a first example embodiment of the present subject matter and as may be used in the example packaged terminal air conditioner unit of FIG. 1.
Figure 3:
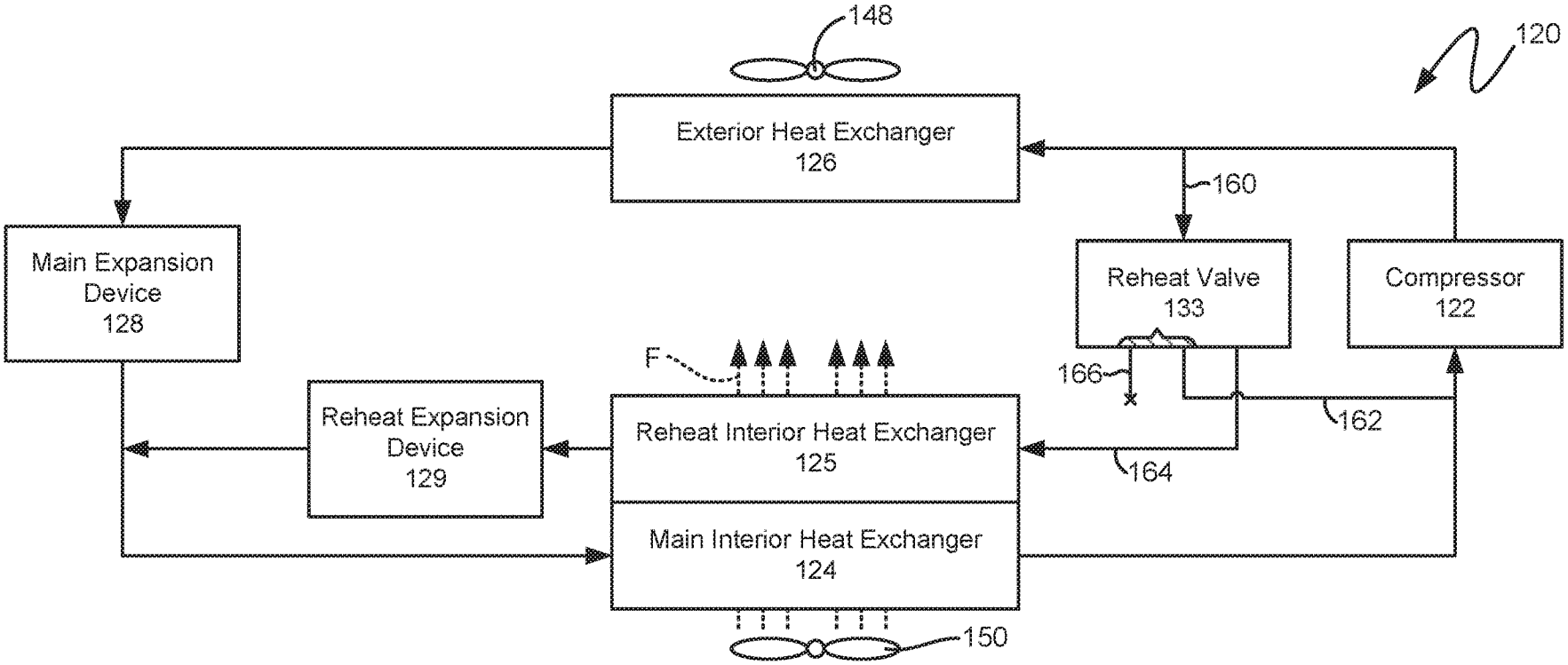

FIGS. 2 and 3 are schematic views of a sealed system 120 according to a first example embodiment of the present subject matter. Sealed system 120 may be used in packaged terminal air conditioner unit 100 or any other suitable packaged terminal air conditioner. Sealed system 120 generally operates in a heat pump cycle. As discussed in greater detail below, sealed system 120 includes features for switching a section of an interior heat exchanger 124 between cooling and re-heating in a cost-effective manner. Thus, e.g., sealed system 120 may not require an extra coil that adds cost and restricts airflow as in known sealed systems.

As may be seen in FIGS. 2 and 3, sealed system 120 includes a compressor 122, a main interior heat exchanger or coil 124, a hybrid or reheat interior heat exchanger or coil 125 and an exterior heat exchanger or coil 126. As is generally understood, various conduits may be utilized to flow refrigerant between the various components of sealed system 120. Thus, e.g., main interior coil 124, reheat interior coil 125 and exterior coil 126 may be between and in fluid communication with one another and compressor 122 via suitable conduits, such as copper and/or aluminum tubing.

In FIG. 2, sealed system 120 is shown in a cooling mode. Conversely, sealed system 120 is shown in a reheat mode in FIG. 3. Sealed system 120 includes a reheat valve 133 that selectively adjusts sealed system 120 between the cooling mode shown in FIG. 2 and the reheat mode shown in FIG. 3. Reheat valve 133 may be a known four-way valve, such as is commonly used as a reversing valve in known packaged terminal air conditioner units. Such four-way valve may include a solenoid controlled pilot valve that shifts a shuttle within the four-way valve. The operation and construction of such four-way valves is well known and not described in detail herein. As discussed in greater detail below, reheat valve 133 may provide a cost effective mechanism to adjust sealed system 120 between the cooling and reheat modes.

Sealed system 120 includes a plurality of conduits that connects reheat valve 133 to various components of sealed system 120. In particular, sealed system 120 includes a first conduit 160, a second conduit 162, a third conduit 164 and a fourth conduit 166. Each one of first conduit 160, second conduit 162, third conduit 164 and fourth conduit 166 may be connected to a respective port of reheat valve 133. In particular, first conduit 160 connects and provides fluid communication between compressor 122 and exterior coil 126. Thus, compressed refrigerant from compressor 122 may flow through first conduit 160 to exterior coil 126, e.g., in both the cooling mode and the reheat mode. A branch of first conduit 160 also extends to reheat valve 133. Thus, compressed refrigerant from compressor 122 may also flow through first conduit 160 to reheat valve 133, e.g., in the reheat mode. Second conduit 162 connects and provides fluid communication between reheat valve 133 and compressor 122. Thus, refrigerant may flow from reheat valve 133 to compressor 122 via second conduit 162, e.g., in the cooling mode. Third conduit 164 connects and provides fluid communication between reheat interior coil 125 and reheat valve 133. Thus, refrigerant from reheat interior coil 125 may flow to reheat valve 133 via third conduit 164 and/or refrigerant from reheat valve 133 may flow to reheat interior coil 125 via third conduit 164.

As may be seen from the above, first conduit 160, second conduit 162 and third conduit 164 may provide fluid flow paths for refrigerant. In contrast, fourth conduit 166 is blocked or plugged. Thus, during operation of compressor 122 refrigerant may not flow through fourth conduit 166 between components of sealed system 120. By blocking or plugging fourth conduit 166, reheat valve 133 may function as a three-way valve despite being constructed as a four-way valve. Fourth conduit 166 may be soldered, capped, etc. to block a port of reheat valve 133. Thus, one port of reheat valve 133 may be blocked or plugged such that no refrigerant flows through the port of reheat valve 133 in the cooling mode or the reheat mode (or a heat pump mode).

Turning to FIG. 2, during operation of sealed system 120 in the cooling mode, refrigerant flows from main interior coil 124 and reheat interior coil 125 and flows through compressor 122. For example, refrigerant may exit main interior coil 124 and/or reheat interior coil 125 as a fluid in the form of a superheated vapor, and the refrigerant may enter compressor 122. Compressor 122 is operable to compress the refrigerant. Accordingly, the pressure and temperature of the refrigerant may be increased in compressor 122 such that the refrigerant becomes a more superheated vapor.

Main interior coil 124 and reheat interior coil 125 may be combined in a single heat exchanger. For example, main interior coil 124 may be one or more row(s) within the single heat exchanger, and reheat interior coil 125 may be one or more other row(s) within the single heat exchanger. Thus, main interior coil 124 and reheat interior coil 125 need not be separate coils in certain example embodiments.

Exterior coil 126 is disposed downstream of compressor 122 in the cooling mode and acts as a condenser. Thus, exterior coil 126 is operable to reject heat into the exterior atmosphere at exterior side portion 114 of casing 110 when sealed system 120 is operating in the cooling mode. For example, the superheated vapor from compressor 122 may enter exterior coil 126 via first conduit 160. Within exterior coil 126, the refrigerant from compressor 122 transfers energy to the exterior atmosphere and condenses into a saturated liquid and/or liquid vapor mixture. An exterior air handler or fan 148 is positioned adjacent exterior coil 126 may facilitate or urge a flow of air from the exterior atmosphere across exterior coil 126 in order to facilitate heat transfer. In the cooling mode, reheat valve 133 connects first conduit 160 and fourth conduit 166. Thus, e.g., refrigerant flow from reheat valve 133 may be blocked at fourth conduit 166 in the cooling mode.

Sealed system 120 also includes a main expansion device 128. Main expansion device 128 may be a capillary tube, an electronic expansion valve, etc. Main expansion device 128 is disposed between main interior coil 124 and exterior coil 126, e.g., such that main expansion device 128 extends between and fluidly couples main interior coil 124 and exterior coil 126. Refrigerant, which may be in the form of high liquid quality/saturated liquid vapor mixture, may exit exterior coil 126 and travel through main expansion device 128 before flowing through main interior coil 124. Main expansion device 128 may generally expand the refrigerant, lowering the pressure and temperature thereof. The refrigerant may then be flowed through main interior coil 124.

Main interior coil 124 is disposed downstream of main expansion device 128 in the cooling mode and acts as an evaporator. Thus, main interior coil 124 is operable to heat refrigerant within main interior coil 124 with energy from the interior atmosphere at interior side portion 112 of casing 110 when sealed system 120 is operating in the cooling mode. For example, the liquid or liquid vapor mixture refrigerant from main expansion device 128 may enter main interior coil 124. Within main interior coil 124, the refrigerant from main expansion device 128 receives energy from the interior atmosphere and vaporizes into superheated vapor and/or high quality vapor mixture. An interior air handler or fan 150 is positioned adjacent main interior coil 124 may facilitate or urge a flow of air from the interior atmosphere across main interior coil 124 in order to facilitate heat transfer.

Sealed system 120 further includes a reheat expansion device 129. Reheat expansion device 129 may be a capillary tube, an electronic expansion valve, etc. In certain example, embodiments, main expansion device 128 and reheat expansion device 129 may be combined in a dual electronic expansion valve. Reheat expansion device 129 is positioned such that refrigerant from main expansion device 128 flows through reheat expansion device 129 prior to entering reheat interior coil 125 in the cooling mode. Thus, the refrigerant may flow in series through main expansion device 128 and reheat expansion device 129 prior to entering reheat interior coil 125. Reheat expansion device 129 may generally expand the refrigerant, lowering the pressure and temperature thereof. The refrigerant may then be flowed through reheat interior coil 125.

Reheat interior coil 125 is disposed downstream of reheat expansion device 129 in the cooling mode and acts as an evaporator. Thus, reheat interior coil 125 is operable to heat refrigerant within reheat interior coil 125 with energy from the interior atmosphere at interior side portion 112 of casing 110 when sealed system 120 is operating in the cooling mode. For example, the liquid or liquid vapor mixture refrigerant from reheat expansion device 129 may enter reheat interior coil 125. Within reheat interior coil 125, the refrigerant from reheat expansion device 129 receives energy from the interior atmosphere and vaporizes into superheated vapor and/or high quality vapor mixture. As may be seen from the above, refrigerant within sealed system 120 may flow in parallel within main interior coil 124 and reheat interior coil 125 in the cooling mode.

Turning to FIG. 3, during operation of sealed system 120 in the reheat mode, refrigerant flows in a similar manner to that described above in the cooling mode. However, the flow of refrigerant through reheat interior coil 125 is reversed in the reheat mode relative to the cooling mode. In particular, reheat valve 133 shifts from connecting first conduit 160 and fourth conduit 166 in the cooling mode to connecting first conduit 160 and third conduit 164 in the reheat mode. Thus, e.g., compressed refrigerant from compressor 122 is flowable through reheat valve 133 to reheat interior coil 125 in the reheat mode.

Reheat interior coil 125 is disposed downstream of compressor 122 in the reheat mode and acts as a condenser. Thus, reheat interior coil 125 is operable to reject heat into air flowing through reheat interior coil 125 from main interior coil 124 when sealed system 120 is operating in the reheat mode. For example, the superheated vapor from compressor 122 may enter reheat interior coil 125 via third conduit 164. Within reheat interior coil 125, the refrigerant from compressor 122 transfers energy to the flow of air F through reheat interior coil 125 and condenses into a saturated liquid and/or liquid vapor mixture. From reheat interior coil 125, the refrigerant may combine with the stream of refrigerant at main expansion device 128 and flow into main interior coil 124.

Interior air handler 150 may be positioned to flow air through both main interior coil 124 and reheat interior coil 125 in order to facilitate heat transfer. Thus, as shown in FIGS. 2 and 3, interior air handler 150 is operable to generate a flow of air F through both main interior coil 124 and reheat interior coil 125. Main interior coil 124 may be positioned upstream of reheat interior coil 125 on the flow of air F. Thus, within the flow of air F, the interior atmosphere at interior side portion 112 of casing 110 may first pass through main interior coil 124 prior to flowing through reheat interior coil 125 during operation of interior air handler 150.

By heating the flow of air F, reheat interior coil 125 may assist with avoiding excessive cooling of the interior atmosphere at interior side portion 112 of casing 110 while main interior coil 124 operates to dehumidify the interior atmosphere at interior side portion 112 of casing 110. As may be seen from the above, reheat valve 133 is operable to shift sealed system 120 between the cooling mode and the reheat mode. Because reheat valve 133 may be constructed as a four-way valve but function as a three-way valve within sealed system, reheat valve 133 may advantageously provide a cost effective mechanism for shifting sealed system 120 between the cooling mode and the reheat mode.

Figure 4:
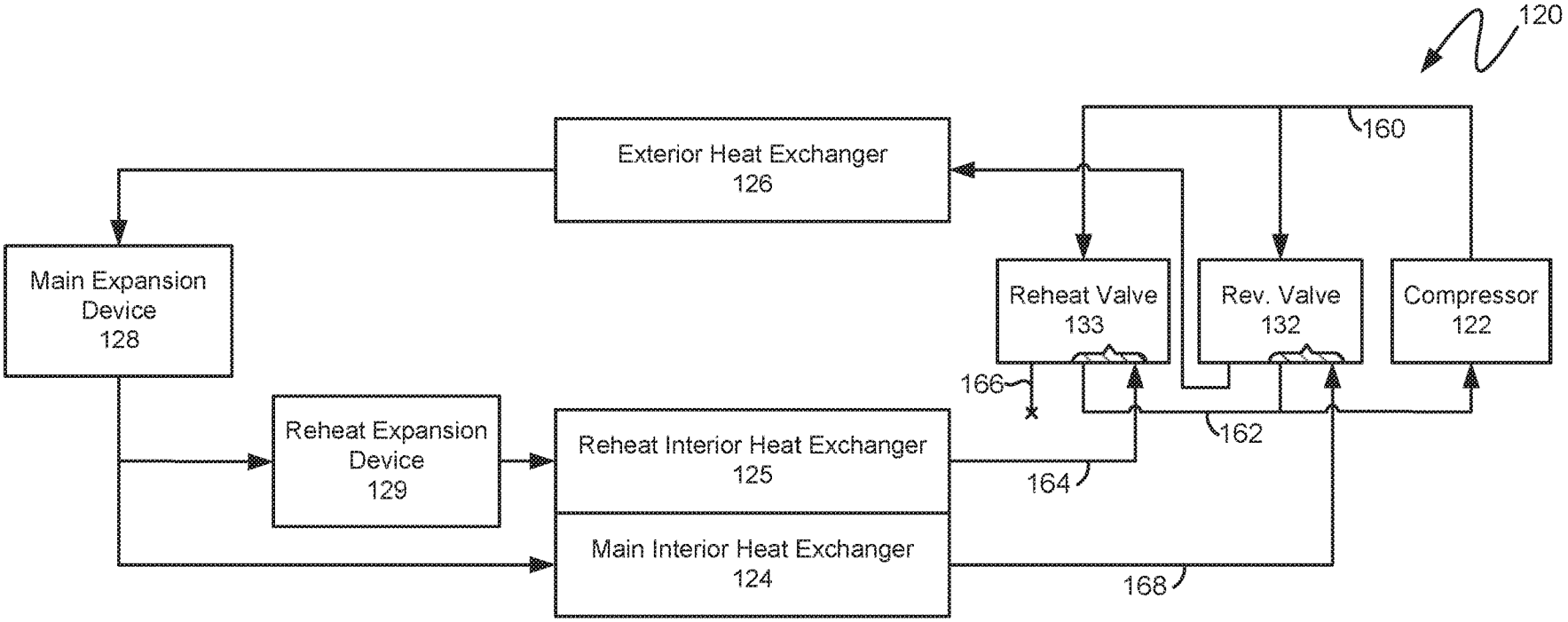
FIGS. 4, 5 and 6 are schematic views of a sealed system according to a second example embodiment of the present subject matter and as may be used in the example packaged terminal air conditioner unit of FIG. 1.
Figure 5:
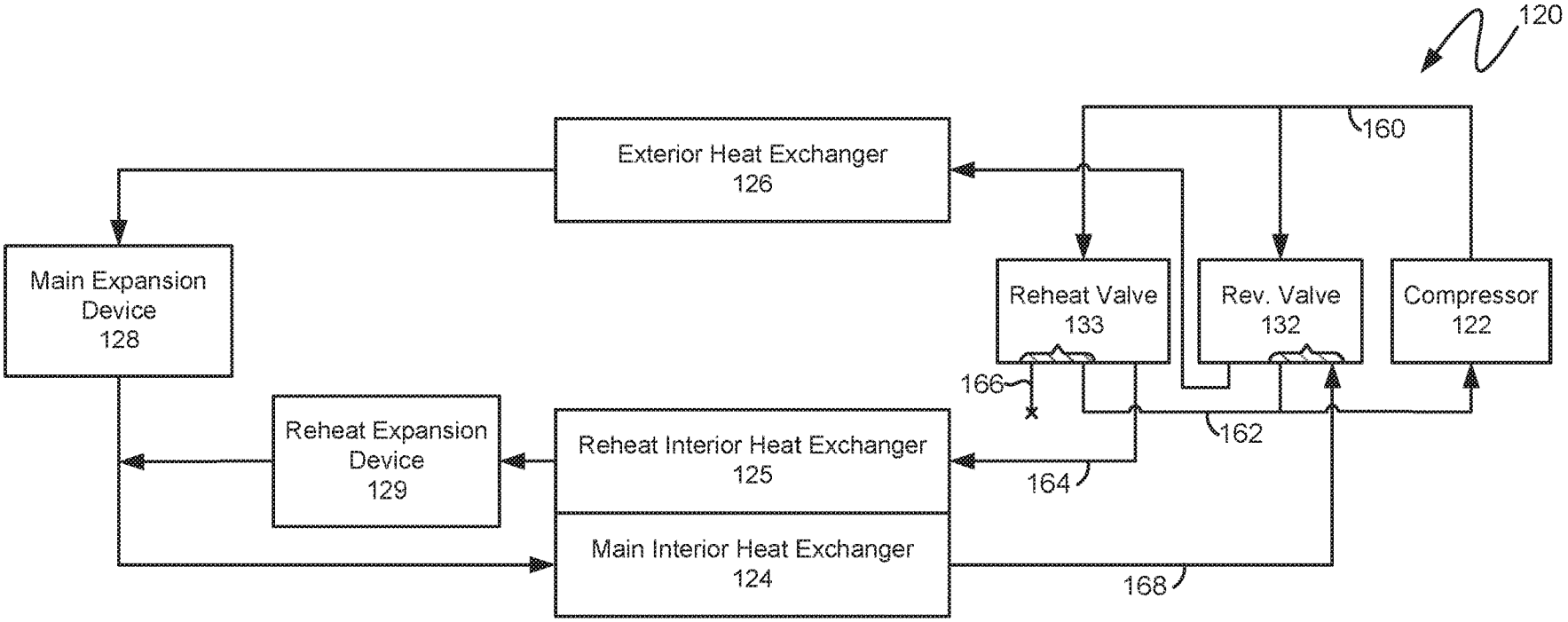
Figure 6:
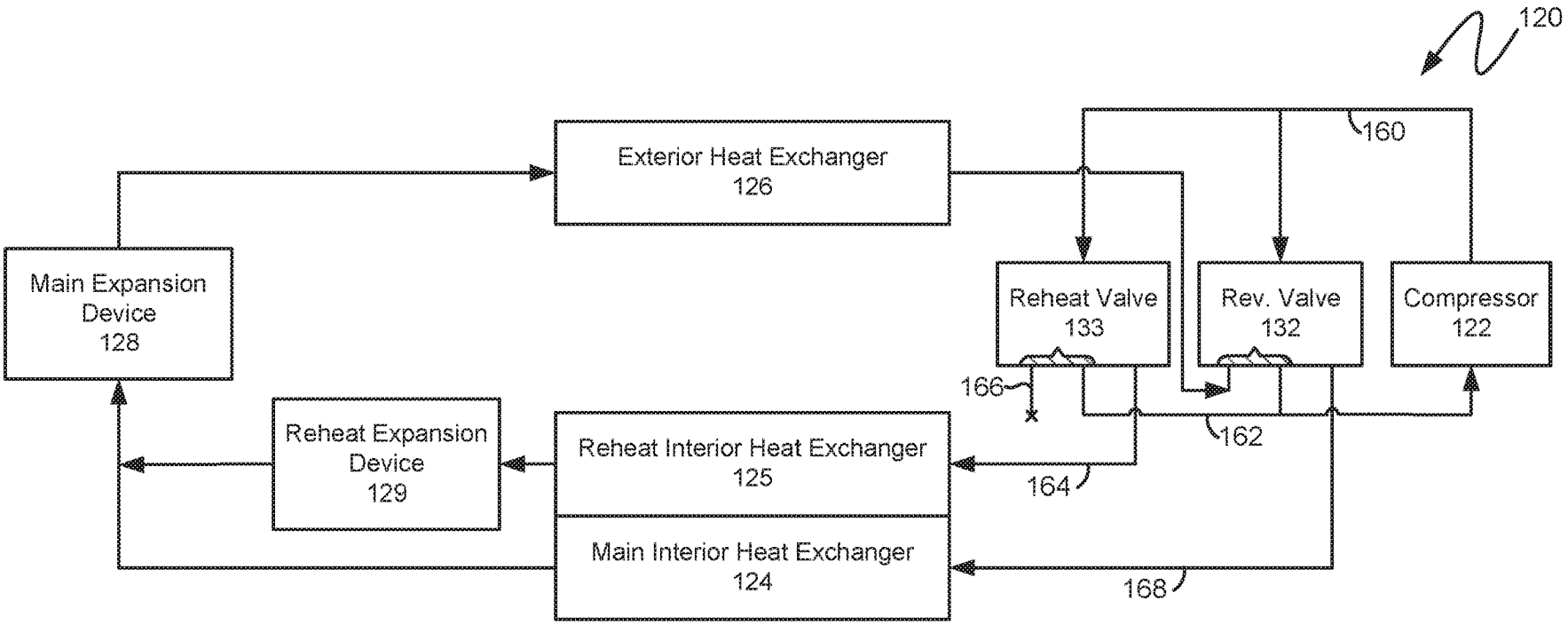

FIGS. 4, 5 and 6 are schematic views of sealed system 120 according to a second example embodiment of the present subject matter. The example embodiment of sealed system 120 shown in FIGS. 4, 5 and 6 includes similar components and operates in a similar manner to the example embodiment of sealed system 120 shown in FIGS. 2 and 3. Thus, in addition to being operable in the cooling mode and the reheat mode, the example embodiment of sealed system 120 shown in FIGS. 4, 5 and 6 is also operable in a heat pump mode. In FIG. 4, sealed system 120 is shown in the cooling mode. Conversely, sealed system 120 is shown in the reheat mode in FIG. 5, and sealed system 120 is shown in the heat pump mode in FIG. 6.

To shift between the cooling mode and the heat pump mode, sealed system 120 includes a reversing valve 132. Reversing valve 132 may be a known four-way valve. In particular, reversing valve 132 and reheat valve 133 may both be four-way valves. In certain example embodiments, reversing valve 132 and reheat valve 133 may be the same type and construction of four-way valves. Thus, sealed system 120 may include two of the same type of four-way valves to provide a cost effective mechanism for adjusting sealed system 120 between the cooling, reheat and heat pump modes.

Reversing valve 132 selectively directs compressed refrigerant from compressor 122 to either main interior coil 124 or exterior coil 126. For example, in a cooling mode, reversing valve 132 is arranged or configured to direct compressed refrigerant from compressor 122 to exterior coil 126. Conversely, in a heating mode, reversing valve 132 is arranged or configured to direct compressed refrigerant from compressor 122 to main interior coil 124. Thus, reversing valve 132 permits sealed system 120 to adjust between the heating mode and the cooling mode.

During operation of sealed system 120 in the heating mode, reversing valve 132 and reheat valve 133 reverse the direction of refrigerant flow through sealed system 120 relative to the cooling mode. Thus, in the heating mode, main interior coil 124 and reheat interior coil 125 are disposed downstream of compressor 122 and act as a condenser, e.g., such that main interior coil 124 and reheat interior coil 125 are operable to reject heat into the interior atmosphere at interior side portion 112 of casing 110. In addition, exterior coil 126 is disposed downstream of main expansion device 128 in the heating mode and acts as an evaporator, e.g., such that exterior coil 126 is operable to heat refrigerant within exterior coil 126 with energy from the exterior atmosphere at exterior side portion 114 of casing 110.

It should be understood that sealed system 120 described above is provided by way of example only. In alternative example embodiments, sealed system 120 may include any suitable components for heating and/or cooling air with a refrigerant. Similarly, sealed system 120 may have any suitable arrangement or configuration of components for heating and/or cooling air with a refrigerant in alternative example embodiments.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An air conditioner unit, comprising:

a compressor operable to increase a pressure of a refrigerant;

an exterior coil;

a main interior coil;

a main expansion device comprising a capillary tube or an electronic expansion valve, the main expansion device connected in series between the exterior coil and the main interior coil such that the main expansion device fluidly connects the exterior coil and the main interior coil, the capillary tube or the electronic expansion valve of the main expansion device configured to expand refrigerant flowing from the exterior coil to the main interior coil in a cooling mode;

a reheat interior coil positioned adjacent the main interior coil;

a reheat valve operable to selectively adjust a flow direction through the reheat interior coil;

a reheat expansion device comprising a capillary tube or an electronic expansion valve, the reheat expansion device connected in series between the main expansion device and the reheat interior coil in the cooling mode such that the reheat expansion device fluidly connects the main expansion device and the reheat interior coil in the cooling mode, the capillary tube or the electronic expansion valve of the reheat expansion device configured to further expand the refrigerant flowing from the main expansion device to the reheat interior coil in the cooling mode, the reheat expansion device connected in series between the reheat interior coil and the main interior coil in a reheat mode such that the reheat expansion device fluidly connects the reheat interior coil and the main interior coil in the reheat mode, the capillary tube or the electronic expansion valve of the reheat expansion device configured to expand refrigerant flowing from the reheat interior coil to the main interior coil in the reheat mode, wherein the reheat valve is a four-way valve, and one port of the four-way valve is blocked.

2. The air conditioner unit of claim 1, further comprising a first conduit, a second conduit, a third conduit, and a fourth conduit.

3. The air conditioner unit of claim 2, wherein the first conduit connects and provides fluid communication between the compressor, the exterior coil and the reheat valve such that the refrigerant from the compressor is flowable to the exterior coil and the reheat valve through the first conduit.

4. The air conditioner unit of claim 2, wherein the second conduit connects and provides fluid communication between the reheat valve and the compressor such that refrigerant from the reheat valve is flowable to the compressor through the second conduit in the cooling mode.

5. The air conditioner unit of claim 2, wherein the third conduit connects and provides fluid communication between the reheat interior coil and the reheat valve such that refrigerant is flowable between the reheat interior coil and the reheat valve through the third conduit.

6. The air conditioner unit of claim 2, wherein the fourth conduit is plugged.

7. The air conditioner unit of claim 1, further comprising a reversing valve, wherein the reversing valve is another four-way valve, the reversing valve and the reheat valve being the same type of four-way valve.

8. The air conditioner unit of claim 1, further comprising an interior fan operable to urge a flow of air through the main interior coil and the reheat interior coil, the reheat interior coil positioned downstream of the main interior coil in the flow of air.

9. An air conditioner unit, comprising:

a compressor operable to increase a pressure of a refrigerant;

an exterior coil;

a main interior coil;

a bulkhead positioned between the exterior coil and the main interior coil;

a main expansion device comprising a capillary tube or an electronic expansion valve, the main expansion device connected in series between the exterior coil and the main interior coil such that the main expansion device fluidly connects the exterior coil and the main interior coil, the capillary tube or the electronic expansion valve of the main expansion device configured to expand refrigerant flowing from the exterior coil to the main interior coil in a cooling mode;

a reheat interior coil positioned adjacent the main interior coil;

a reheat valve operable to selectively adjust a flow direction through the reheat interior coil;

a reheat expansion device comprising a capillary tube or an electronic expansion valve, the reheat expansion device connected in series between the main expansion device and the reheat interior coil in the cooling mode such that the reheat expansion device fluidly connects the main expansion device and the reheat interior coil in the cooling mode, the capillary tube or the electronic expansion valve of the reheat expansion device configured to further expand the refrigerant flowing from the main expansion device to the reheat interior coil in the cooling mode, the reheat expansion device connected in series between the reheat interior coil and the main interior coil in a reheat mode such that the reheat expansion device fluidly connects the reheat interior coil and the main interior coil in the reheat mode, the capillary tube or the electronic expansion valve of the reheat expansion device configured to expand refrigerant flowing from the reheat interior coil to the main interior coil in the reheat mode, wherein the reheat valve is a four-way valve, and one port of the four-way valve is blocked.

10. The air conditioner unit of claim 9, further comprising a first conduit, a second conduit, a third conduit, and a fourth conduit.

11. The air conditioner unit of claim 10, wherein the first conduit connects and provides fluid communication between the compressor, the exterior coil and the reheat valve such that the refrigerant from the compressor is flowable to the exterior coil and the reheat valve through the first conduit.

12. The air conditioner unit of claim 10, wherein the second conduit connects and provides fluid communication between the reheat valve and the compressor such that refrigerant from the reheat valve is flowable to the compressor through the second conduit in the cooling mode.

13. The air conditioner unit of claim 10, wherein the third conduit connects and provides fluid communication between the reheat interior coil and the reheat valve such that refrigerant is flowable between the reheat interior coil and the reheat valve through the third conduit.

14. The air conditioner unit of claim 10, wherein the fourth conduit is plugged.

15. The air conditioner unit of claim 9, further comprising a reversing valve, wherein the reversing valve is another four-way valve, the reversing valve and the reheat valve being the same type of four-way valve.

16. The air conditioner unit of claim 9, further comprising an interior fan operable to urge a flow of air through the main interior coil and the reheat interior coil, the reheat interior coil positioned downstream of the main interior coil in the flow of air.

* * * * *